US007543492B2

(12) United States Patent
Becourt

(10) Patent No.: US 7,543,492 B2
(45) Date of Patent: Jun. 9, 2009

(54) VACUUM LINE AND A METHOD OF MONITORING SUCH A LINE

(75) Inventor: Nicolas Becourt, Poisy (FR)

(73) Assignee: Alcatel, Paris (FR)

( * ) Notice: Subject to any disclaimer, the term of this patent is extended or adjusted under 35 U.S.C. 154(b) by 25 days.

(21) Appl. No.: 11/477,361

(22) Filed: Jun. 30, 2006

(65) Prior Publication Data

US 2007/0012099 A1 Jan. 18, 2007

(30) Foreign Application Priority Data

Jul. 4, 2005 (FR) ..... 05 52027

(51) Int. Cl.
*G01M 19/00* (2006.01)

(52) U.S. Cl. ..... 73/168; 702/34; 702/181

(58) Field of Classification Search ..... 73/168; 702/181–184, 34

See application file for complete search history.

(56) References Cited

U.S. PATENT DOCUMENTS

| | | | | |
|---|---|---|---|---|
| 6,178,393 | B1 * | 1/2001 | Irvin | 703/10 |
| 6,260,004 | B1 * | 7/2001 | Hays et al. | 702/183 |
| 6,619,111 | B2 * | 9/2003 | Soneda et al. | 73/168 |
| 2003/0009311 | A1 * | 1/2003 | Ushiku et al. | 702/184 |
| 2003/0153997 | A1 * | 8/2003 | Samata et al. | 700/108 |
| 2003/0154052 | A1 | 8/2003 | Samata | |
| 2003/0158705 | A1 | 8/2003 | Ishii | |
| 2004/0064212 | A1 * | 4/2004 | Samata et al. | 700/108 |
| 2004/0064291 | A1 * | 4/2004 | Samata et al. | 702/182 |
| 2004/0143418 | A1 * | 7/2004 | Ushiku et al. | 702/184 |
| 2005/0091004 | A1 * | 4/2005 | Parlos et al. | 702/185 |
| 2005/0107984 | A1 * | 5/2005 | Samata et al. | 702/183 |
| 2006/0162438 | A1 * | 7/2006 | Schofield et al. | 73/168 |

FOREIGN PATENT DOCUMENTS

EP 0 918 159 A 5/1999

* cited by examiner

*Primary Examiner*—David A. Rogers
(74) *Attorney, Agent, or Firm*—Sughrue Mion, PLLC

(57) ABSTRACT

The present invention provides a vacuum line for pumping gas from a process chamber, the vacuum line comprising at least:

a pump unit comprising a pump body and a motor;
a gas exhaust system;
first measurement means for measuring a functional parameter relating to the motor;
second measurement means for measuring a functional parameter relating to the exhaust system; and
prediction means for calculating the duration of use of the vacuum line.

The prediction means calculate the duration of utilization of the vacuum line prior to failure of the pump unit from the measurement of a functional parameter relating to the motor provided by the first means and the measurement of a functional parameter relating to the exhaust system provided by the second means. In a variant, the vacuum line further includes third measurement means for measuring a functional parameter relating to the pump body, and the prediction means calculate the duration of use while taking account of the measurement of this parameter.

16 Claims, 3 Drawing Sheets

VACUUM LINE AND A METHOD OF MONITORING SUCH A LINE

The present invention relates to the field of predictive and preventative maintenance of a vacuum line associated with a process chamber. The invention relates more particularly to following the progress of the phenomenon whereby the vacuum line becomes polluted with solids (plugging, seizing, etc. . . . ). The invention also extends to the method of monitoring this phenomenon in order to establish a diagnosis and be able to program preventative maintenance actions.

Vacuum lines including at least one pump unit are employed in numerous processes that make use of gases and require a pressure lower than atmospheric pressure. Unfortunately, the gases used in such processes can become transformed into solid by-products. Those by-products can become deposited in the form of a layer on the internal surfaces of the vacuum line, and in particular on the surfaces of pipes, valves, and other accessories, and also on the moving and stationary parts of the pump, or indeed they can accumulate in dead volumes of the vacuum line. That phenomenon can lead to a loss in the performance of the vacuum line, and in particular of the pump unit, or indeed to its failure. It is then inevitable that the process in progress in the associated chamber will be interrupted in order to proceed with cleaning or replacing the element in question of the vacuum line, and in particular the pump unit. The costs induced by such non-programmed interruptions in production are considerable.

At present, vacuum line maintenance is based both on corrective actions and on preventative actions.

Corrective maintenance is performed as a function of signals, in particular signals emitted by sensors integrated in the pump unit. Two thresholds are defined for each analog measurement: a warning threshold and an alarm threshold. The warning threshold corresponds to an analog value that is abnormally high, indicative of drift in the conditions of use of the pump unit relative to its nominal capacities. Crossing the alarm threshold means that the conditions of use of the pump unit have exceeded the unit's nominal capacities and it stops automatically. In order to minimize the magnitude of the action taken, the best situation is to be able to undertake corrective action as soon as the warning level has been exceeded.

Partial or total preventative maintenance operations are also performed at defined periods as a function of the application for which the vacuum line is used. Such periodicity is initially evaluated theoretically and then adjusted by experience. Nevertheless, periodicity is not always well adapted to the real state of wear of the components in the pump unit or the real state of pollution in the vacuum line, and that can lead to operations that are performed too late or else too early.

When performing corrective maintenance, the difficulty lies in tracking the warning and alarm thresholds of the analog signals from the pump unit, which tracking does not make it possible to obtain an elaborate diagnosis of the cause of the failure. Another problem is the way the abnormal behavior of the pump unit varies over time, and this can lead to the unit passing quickly from the warning threshold to the alarm threshold. Under such circumstances, it becomes almost impossible to take action before the alarm threshold is reached, and that can lead to irreparable damage to a product that is being fabricated (e.g. a semiconductor wafer), and also to the pump unit.

Document EP-0 828 332 relates to evaluating the duration for which a vacuum pump can be used between maintenance operations. The amount of undesirable material deposited on the rotor of the vacuum pump is estimated by measuring the rotary torque and/or the current drawn by the motor driving the rotor.

The method described in that document presents the drawback of paying attention to parameters that relate to the motor only. Firstly that measurement is polluted by variations in the pumped gas flow, which flow is not always known. Thus, when taking a measurement, it is not possible to distinguish between variation in torque or current that is due to a variation in flow, and variation that is due to pollution of the pump. The use of that method is therefore restricted to small flows, such that the influence of the flow on the motor torque is negligible compared with the influence of pump pollution. Furthermore, that method evaluates only the dynamic behavior of the rotary parts of the pump. It does not make it possible to diagnose the cause of abnormal behavior if that behavior is associated with malfunctioning elements external to the pump unit, such as the gas exhaust system becoming plugged.

Document US-2004/143418 relates to determining the time in which a failure occurs in a dry pump. The lifetime of such a pump is estimated by statistical processing of data characteristic of the pump (current, temperature, vibration, etc. . . . ) combined with characteristics of the fabrication process (gas flow, pressure, substrate temperature, etc. . . . ). That document specifies that it is extremely difficult to predict the lifetime of the pump without taking account of the operating conditions of the process.

When the number of parameters to be monitored is large, that can make exploiting them complex. In addition, the predictive analysis system is not self-contained: it depends on information supplied by the production equipment requiring a communications line to be installed between that equipment and the server for supervising the pump. That communications line is difficult to set up (confidentiality concerning data belonging to the equipment manufacturer or the client, technical difficulties, etc. . . . ) and proper operation thereof is not guaranteed.

Document WO 2004/011810 relates to a method of monitoring the state of a system including a pump, following a test stage in which the pump is tested under pre-established conditions. During the test period, signals representative of proper operation of the system are recorded. The pump is diagnosed by measuring the torque or the current consumption of the motor during the test stage, i.e. not during production stages. Test conditions, and in particular the pumped gas flow, are pre-established in order to be able to compare the result of a measurement with a reference stored under the same gas flow conditions.

That method cannot be implemented during periods of sustained production since for reasons of organization, it is very difficult to interrupt production in order to proceed with testing the pump unit. In addition, that method does not enable plugging of the pump exhaust system to be predicted.

The problem is thus to diagnose the state of solid pollution (plugging, seizing, etc. . . . ) in a vacuum line that includes at least one pump unit, in order to plan preventative maintenance operations at the most opportune moment and to anticipate failure of the pump unit, regardless of the magnitude of the pumped flow, without taking into consideration conditions of parameters other than those coming from the vacuum line, and without interrupting production.

The present invention provides a vacuum line for pumping gas from a process chamber, the vacuum line including:

- a pump unit comprising a pump body and a motor;
- a gas exhaust system;
- first measurement means for measuring a functional parameter relating to the motor;

second measurement means for measuring a functional parameter relating to the exhaust system; and prediction means for calculating the remaining lifetime of the vacuum line.

According to the invention, the prediction means calculate the remaining lifetime of the vacuum line prior to failure of the pump unit, on the basis of the measurement of a functional parameter relating to the motor provided by the first means and the measurement of a functional parameter relating to the exhaust system provided by the second means.

According to the invention, the prediction means calculate the duration of use of the vacuum line prior to failure of the pump unit, on the basis of the measurement of a functional parameter relating to the motor provided by the first means and the measurement of a functional parameter relating to the exhaust system provided by the second means.

The means for measuring a functional parameter relating to the motor are means for measuring at least one characteristic preferably selected from the power or the current consumed by the motor, its rotary torque, and vibration. More preferably, the means for measuring a functional parameter relating to the motor are means for measuring the power consumed by the motor.

The means for measuring a functional parameter relating to the exhaust system are means for measuring the pressure of the gas in the exhaust system.

The vacuum line of the invention preferably includes first means for measuring the power consumed by the motor, second means for measuring the pressure of the gas in the exhaust system, and means for predicting the remaining lifetime of the vacuum line on the basis of the measurement of the power consumed by the motor and the measurement of the gas pressure in the exhaust system.

In a variant of the invention, the vacuum line may further include third means for measuring a functional parameter relating to the pump body. The means for measuring a function parameter relating to the pump body are means for measuring at least one characteristic preferably selected from the temperature of the pump body, mechanical and/or acoustic vibration of the pump body, nitrogen purge flow rate, and the positions of temperature regulation valves.

The vacuum line preferably further includes means for predicting the remaining lifetime of the vacuum line by making use of the measurement of a functional parameter relating to the pump body.

To this end, other sensors may also be integrated in the pump unit, for example a vibration sensor, an acoustic sensor, or an accelerometer.

Advantageously, the prediction means calculate the remaining lifetime of the vacuum line on the basis of the measurement of a functional parameter relating to the motor as supplied by the first means, the measurement of a functional parameter relating to the exhaust system as provided by the second means, and the measurement of a functional parameter relating to the pump body as provided by the third means.

The vacuum line of the invention is thus capable of performing self-diagnosis, i.e. diagnosis that is performed without correlation with signals external to the vacuum line.

The use of a vacuum line of the invention including a system suitable for providing a diagnosis makes it possible to avoid major failures while the installation that includes the vacuum line is in an active production stage, and it does this by predicting such failures. Any failure under such circumstances can be harmful to the quality of the product being fabricated and can even lead to it being destroyed, thus leading to significant financial loss for the customer.

The invention also provides a method of monitoring a vacuum line according to any preceding claim, the method comprising the following steps:

measuring a functional parameter relating to the motor;

measuring a functional parameter relating to the gas exhaust system;

correlating variation in time of the measured functional parameter relating to the motor and of the measured functional parameter relating to the exhaust system; and deducing therefrom the remaining lifetime of the vacuum line prior to failure.

The method of the invention consists in identifying and tracking progress of the pollution phenomenon within a vacuum line. Pollution is due to solid by-products coming from the transformation of the process gases for the process that is implemented in a process chamber with which the vacuum line is associated. This phenomenon is monitored by making use of the characteristic variation over time of certain signals coming from measurement means such as sensors placed on the exhaust system and on the motor driving the pump.

The remaining lifetime is obtained in particular by statistical processing based on the variation over time in the amplitudes of the measured parameters in order to evaluate the risk of the vacuum line becoming clogged.

The parameters that are preferably followed in the context of the invention are firstly at least one functional parameter relating to the motor and secondly at least one functional parameter relating to the exhaust system.

The measured functional parameter relating to the motor is at least one characteristic preferably selected from the power or the current consumed by the motor, its rotary torque, and vibration. More preferably, the measured functional parameter relating to the motor is the power consumed.

The measured functional parameter relating to the exhaust system is preferably the gas pressure in the exhaust system.

The parameters which are particularly advantageous to track in correlation are the power consumed by the motor and the gas pressure in the exhaust system. In an advantageous embodiment of the invention, the measured functional parameter relating to the motor is the power consumed by the motor, the measured functional parameter relating to the gas exhaust system is the gas pressure in the exhaust system, and the remaining lifetime of the vacuum line is calculated from the correlated variation over time in the power consumed by the motor and the gas pressure in the exhaust system.

It is possible also to measure a functional parameter relating to the pump body. The functional parameter relating to the pump body is at least one characteristic preferably selected from the treatment of the pump body, pump body vibration, nitrogen purge flow rate, and the positions of treatment regulation valves. By way of example, information concerning the open or closed state of the treatment regulation water valves can reveal a failure in the cooling network that is not directly visible by reading the temperature of the pump body.

It is also possible to complete diagnosis of the functional state of the pump and the organization of maintenance by direct observation of variation in the parameters of the pump unit over time by recording the data in the supervisory network to which the pumps are connected.

The tracking of correlation in the variation over time of each of the selected parameters may also optionally include correlating measured parameters with parameters external to the vacuum line, for example parameters characteristic of the equipment to which the vacuum line is connected.

The invention presents numerous advantages. The method of the invention uses and exploits data provided by the measurement means associated with the vacuum line, which data can be recorded, in order to identify abnormal behavior of the pump unit and to perform diagnosis for the purpose of early anticipation of a problem before the analog signals have exceeded the warning and alarm thresholds.

The method of the invention makes it possible to identify the influence of pollution on the state of cleanliness in the gas exhaust system. The method of the invention thus detects pollution of elements external to the pump unit such as the pipe for exhausting pumped gas, an in-line valve or a trap in said pipe, or indeed the connection between said pipe and the gas treatment system.

When used in a diagnosis system, the method of the invention makes it possible to privilege predictive maintenance, i.e. to perform maintenance on the vacuum line only when there is a real need. This serves to avoid preventative maintenance operations that are expensive and sometimes not justified. Diagnosis is early, thus making it possible to minimize damage associated with component wear, and thus making it possible to further reduce the cost of maintenance.

The present invention is usable in a diagnosis software application that can be integrated in the in situ supervisory network of the pump unit, in the pump unit itself, or indeed in a remote system. The invention can enable this software application to perform self-diagnosis of the vacuum line, i.e. diagnosis without correlation with signals that are external to the pump unit.

When associated with an automatic diagnosis watch system, the invention can make it possible to lessen routine monitoring of the vacuum line and thus to increase the availability of staff responsible for maintenance.

Other objects, characteristics, and advantages of the present invention appear from the following description of a particular embodiment given by way of non-limiting illustration, and from the accompanying drawings, in which.

Figure 5:
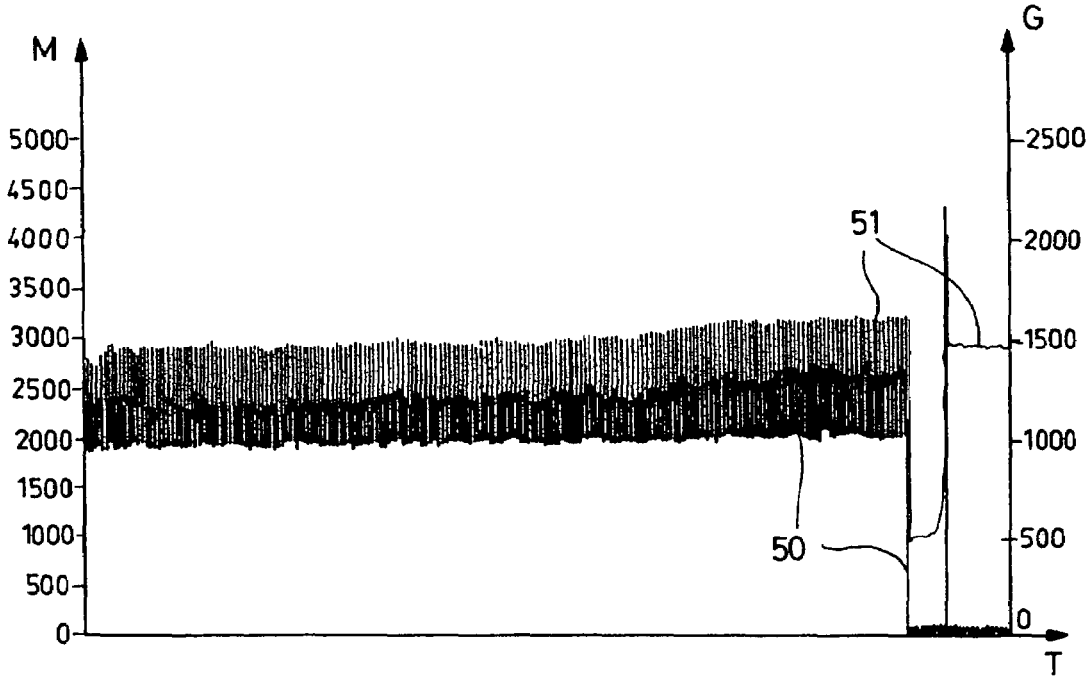
Figure 6:
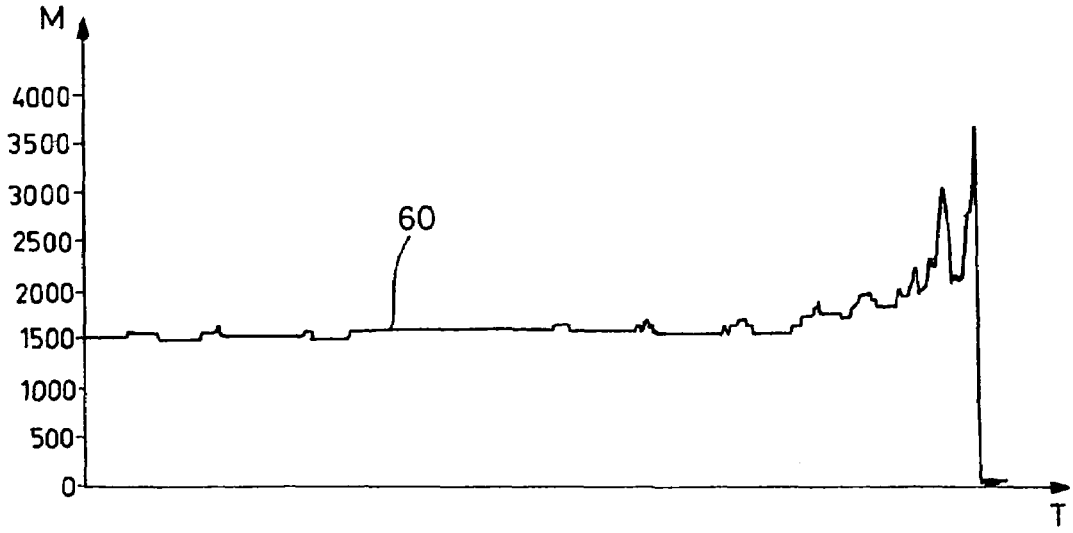

FIG. 5 shows a progressive increase in the power consumed by the motor and in the gas pressure that is caused by the exhaust pipe becoming clogged, the power M in watts and the pressure G in millibars are plotted up the ordinate, while time T is plotted along the abscissa without units; and FIG. 6 shows random variation in the power consumed by the motor which is a sign of imminent blockage of the moving parts of the pump unit, the power M in watts being plotted up the ordinate and time T being plotted along the abscissa without units.

Figure 1:
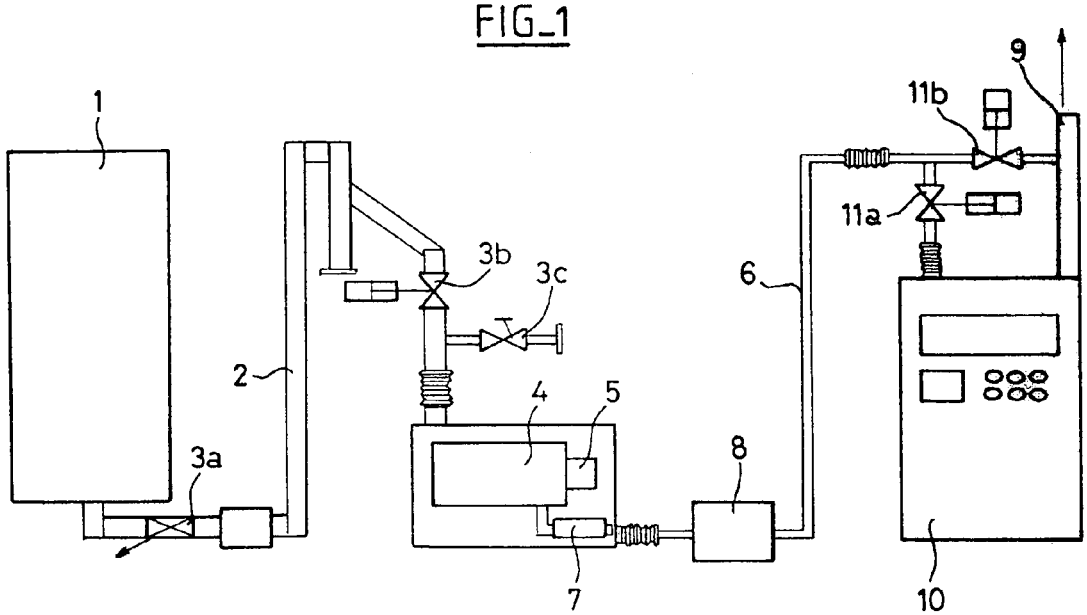
FIG. 1 is a diagram of a vacuum line of the invention.

The installation shown in FIG. 1 comprises a process chamber 1 for treating a substrate. By way of example, it can be subjected to deposition, etching, or ion implantation processes or to heat treatment as used in fabricating microelectronic devices on silicon wafers. The treatment may also be micromachining of semiconductor substrates for making microelectronic mechanical systems (MEMSs) or micro-optical electronic mechanical systems (MOMESs). The process chamber 1 is connected by a pipe 2 fitted with valves 3*a*, 3*b*, and 3*c* to a pump body 4 driven by a motor 5. The pump body 4 is connected to an exhaust pipe 6 via a silencer 7. The pipe 6 may be fitted with a trap 8 for trapping solid by-products of the reaction. When the gaseous by-products of the process implemented are unsuitable for exhausting in the general exhaust 9, the gas is exhausted via a treatment installation 10 using valves 11*a* and 11*b*. The process gas might become transformed into solid by-products, which can accumulate in the process chamber 1, in the pipe 2 connecting the chamber 1 to the pump body 4, in the pump body 4, in the silencer 7, in the pipe 6 leading to the gas treatment installation 10, in the trap 8, and in the valves 11*a*, 11*b*. It also frequently happens that the by-products formed upstream from the pump unit are pumped or transferred by gravity into the pump body 4, and thus contribute to the phenomenon of polluting the pump body 4, the silencer 7, the pipe 6 for exhausting pumped gas, the trap 8, and the valves 11*a* and 11*b*.

Figure 2:
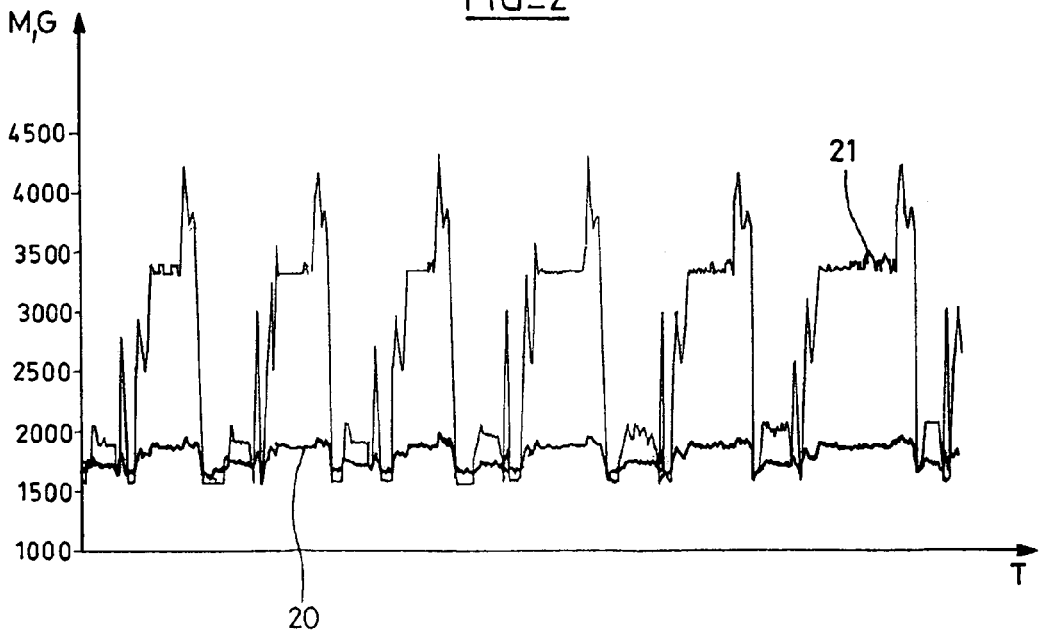
FIG. 2 shows repetitive variation in the power consumed by the motor and in the gas pressure in the exhaust system which is associated with variations in the flow of gas admitted into the pump unit during treatment; the power consumed by the motor M in watts (W) and the gas pressure G in millibars (mbar) are plotted up the ordinate, with time T being plotted along the abscissa without units.
Figure 3:
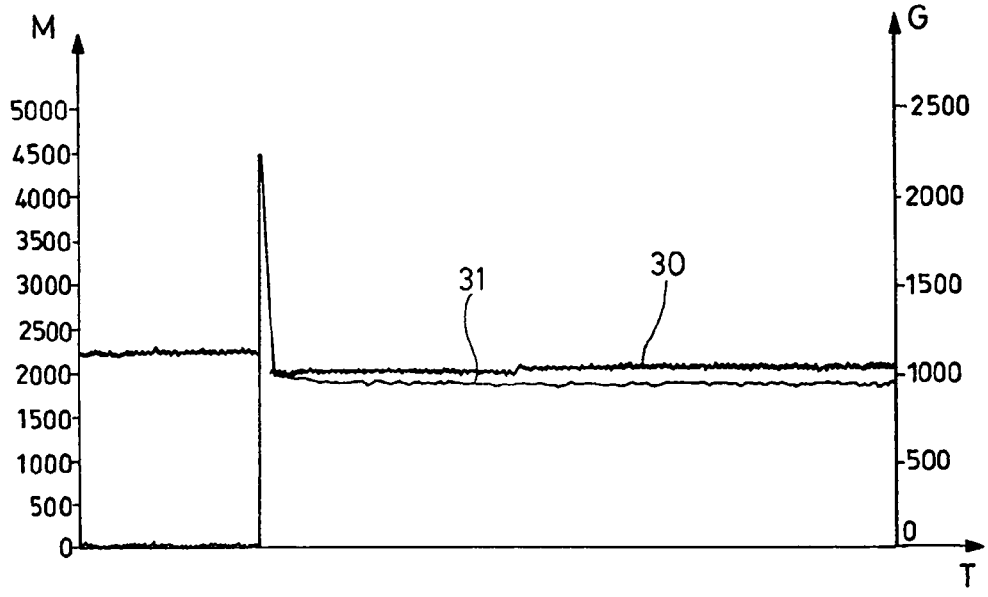
FIG. 3 shows a transient variation in the power consumed by the motor and in the gas pressure, caused by pumping gas from atmospheric pressure; the power M in watts is plotted up the left-hand ordinate and the pressure G in millibars up the right-hand ordinate, with time T being plotted along the abscissa without units.
Figure 4:
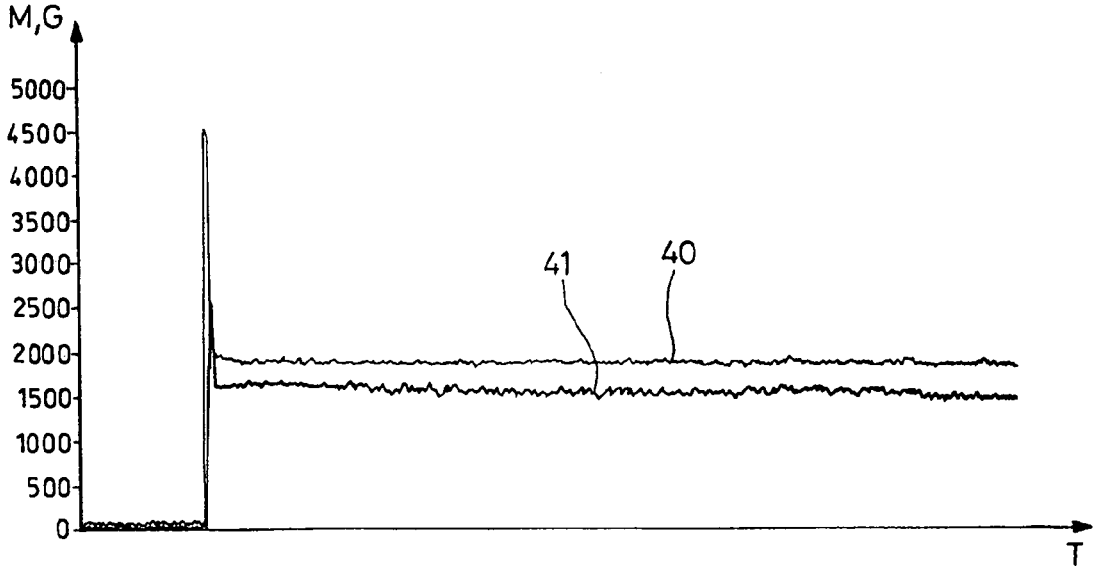
FIG. 4 shows the progressive decrease in the power consumed by the motor after starting; the power M in watts and the pressure G in millibars are plotted up the ordinate, and time T is plotted along the abscissa without units.

The variation in the value of a functional parameter of the pump unit associated with normal operation may be, for example:

- repetitive and reproducible over time, for example FIG. 2 shows variation in the gas pressure G (curve 20) in the exhaust system and variation in the power M consumed by the motor (curve 21) which is due to variations in the gas flow reaching the pump unit while production operations are in progress; or
- transients, e.g. FIG. 3 shows the sudden increase that occurs simultaneously in gas pressure G (curve 30) and in the power M consumed by the motor (curve 31) due to pumping a volume of gas at atmospheric pressure; or indeed
- continuous in time, e.g. FIG. 4 shows the progressive decrease in the power M' consumed by the motor (curve 41) of the primary pump of the unit after starting, which is due to the pump unit heating up and to progressive removal of solid residues that have accumulated in the pump body while it was stopped. The curve 40 shows the power M consumed by the motor of the secondary pump of the unit.

The variation in the value of a parameter associated with abnormal operation may, for example, be:

- continuous in time, e.g. FIG. 5 shows the progressive increase in the power M consumed by the motor (curve 50) and in the gas pressure G (curve 51) in the exhaust system, revealing clogging of the pipe to which the pumped gas is delivered; or indeed
- random, e.g. the curve 60 in FIG. 6 which shows successive peaks in the power M consumed by the motor which are a sign of imminent blocking of the moving parts.

The invention makes it possible in particular to detect the following phenomena before they lead to irreversible failure of the pump unit, in particular clogging of the silencer, of the trap, of the pipe, or of the valves in the gas exhaust system, or under certain conditions internal clogging of the pump unit by solid by-products coming from transformation of the pumped gases.

Clogging is identified by tracking variation in time of the power M consumed by the motor and the gas pressure G. A mathematical algorithm has been determined for measuring this variation and for calculating the time that remains before predefined critical analog thresholds are reached.

Naturally, the present invention is not restricted to the embodiments described, and it can be varied in numerous ways by the person skilled in the art without departing from the spirit of the invention. In particular, without going beyond the ambit of the invention, it is possible to decide to monitor other parameters as well, be they internal or external to the vacuum line, in order to obtain better knowledge about is operating state.

What is claimed is:

1. A vacuum line for pumping gas from a process chamber, the vacuum line comprising:

a pump unit comprising a pump body and a motor;

a gas exhaust system;

first measurement means for measuring a functional parameter relating to the motor;

second measurement means for measuring a functional parameter relating to the exhaust system; and prediction means for calculating the remaining lifetime of the vacuum line on the basis of a correlation between the measurement of the functional parameter relating to the motor provided by the first means and the measurement of the functional parameter relating to the exhaust system provided by the second means.

2. A vacuum line according to claim 1, in which the second means for measuring the functional parameter relating to the exhaust system comprise means for measuring gas pressure in the exhaust system.

3. The vacuum line according to claim 1, wherein the prediction means calculates the remaining lifetime of the vacuum line on the basis of a correlation of a variation in time of the measurement of the functional parameter relating to the motor provided by the first means and the measurement of the functional parameter relating to the exhaust system provided by the second means.

4. A vacuum line according to claim 1, in which the first measurement means for measuring the functional parameter relating to the motor comprise means for measuring at least one characteristic selected from a power consumed by the motor, a current consumed by the motor, a rotary torque of the motor, and motor vibration.

5. A vacuum line according to claim 4, in which the first measurement means for measuring the functional parameter relating to the motor comprises means for measuring the power consumed by the motor.

6. A vacuum line according to claim 4, wherein the first measurement means measures the power consumed by the motor, the second measurement means measures the gas pressure in the exhaust system, and the prediction means predicts the remaining lifetime of the vacuum line from the measurement of the power consumed by the motor and from the measurement of the gas pressure in the exhaust system.

7. A vacuum line according to claim 1, further comprising third measurement means for measuring a functional parameter relating to the pump body.

8. A vacuum line according to claim 7, in which the means for measuring a functional parameter relating to the pump body comprise means for measuring at least one characteristic selected from the treatment of the pump body, pump body vibration, nitrogen purge flow rate, and the positions of treatment regulation valves.

9. A vacuum line according to claim 7, wherein the prediction means calculates the remaining lifetime of the vacuum line on the basis of the measurement of the functional parameter relating to the motor provided by the first means, the measurement of the functional parameter relating to the exhaust system provided by the second means, and the measurement of the functional parameter relating to the pump body provided by the third means.

10. A method of monitoring a vacuum line for pumping gas from a process chamber, the vacuum line comprising at least a pump unit comprising a pump body and a motor; a gas exhaust system; first measurement means for measuring a functional parameter relating to the motor; second measurement means for measuring a functional parameter relating to the exhaust system; and prediction means for calculating the remaining lifetime of the vacuum line on the basis of the measurement of a functional parameter relating to the motor provided by the first means and the measurement of a functional parameter relating to the exhaust system provided by the second means, the method comprising:

measuring a functional parameter relating to the motor;

measuring a functional parameter relating to the gas exhaust system;

correlating a variation in time of the measured functional parameter relating to the motor and of the measured functional parameter relating to the exhaust system; and deducing therefrom the remaining lifetime of the vacuum line.

11. A method according to claim 10, in which the remaining lifetime is obtained by statistical treatment based on the variation over time in the amplitudes of the measured parameters.

12. A method according to claim 10, in which the measured functional parameter relating to the gas exhaust system is the gas pressure in the exhaust system.

13. A method according to claim 10, in which the measured functional parameter relating to the motor is constituted by at least one characteristic selected from the power consumed by the motor, the current consumed by the motor, the rotary torque of the motor, and motor vibration.

14. A method according to claim 13, in which the measured functional parameter relating to the motor is the power consumed by the motor, the measured functional parameter relating to the gas exhaust system is the gas pressure in the exhaust system, and the remaining lifetime of the vacuum line is calculated from the correlated variation over time in the power consumed by the motor and the gas pressure in the exhaust system.

15. A method according to claim 10, in which a functional parameter relating to the pump body is also measured.

16. A method according to claim 15, in which the functional parameter relating to the pump body is constituted by at least one characteristic selected from the temperature of the pump body, pump body vibration, nitrogen purge flow rate, and the positions of temperature regulation valves.

* * * * *